US010308488B2

(12) United States Patent
Hall et al.

(10) Patent No.: US 10,308,488 B2
(45) Date of Patent: Jun. 4, 2019

(54) LOAD-FACING WINCH

(71) Applicants: David R. Hall, Provo, UT (US); Daniel Madsen, Vineyard, UT (US); Benjamin Taylor, Provo, UT (US); Joe Fox, Spanish Fork, UT (US); Lloyd J. Wilson, Herriman, UT (US)

(72) Inventors: David R. Hall, Provo, UT (US); Daniel Madsen, Vineyard, UT (US); Benjamin Taylor, Provo, UT (US); Joe Fox, Spanish Fork, UT (US); Lloyd J. Wilson, Herriman, UT (US)

(73) Assignee: Hall Labs LLC, Provo, UT (US)

( * ) Notice: Subject to any disclaimer, the term of this patent is extended or adjusted under 35 U.S.C. 154(b) by 137 days.

(21) Appl. No.: 15/282,256

(22) Filed: Sep. 30, 2016

(65) Prior Publication Data

US 2018/0093869 A1 Apr. 5, 2018

(51) Int. Cl.

| | |
|---|---|
| ***B66D 1/36*** | (2006.01) |
| ***B66D 1/38*** | (2006.01) |
| ***B66D 1/28*** | (2006.01) |

(52) U.S. Cl.

CPC ..... *B66D 1/365* (2013.01); *B66D 1/28* (2013.01); *B66D 1/38* (2013.01)

(58) Field of Classification Search

CPC .. B66D 1/365; B66D 1/38; B66D 2700/0191; B66D 1/28

See application file for complete search history.

(56) References Cited

U.S. PATENT DOCUMENTS

| | | | | | |
|---|---|---|---|---|---|
| 2,483,688 | A * | 10/1949 | Brown | B66D 1/36 | 242/397.3 |
| 2,959,396 | A * | 11/1960 | Lawrence | B60P 3/14 | 254/273 |
| 3,690,409 | A * | 9/1972 | Brauss | B66D 1/14 | 182/142 |
| 4,334,670 | A * | 6/1982 | Kawabe | B66D 1/38 | 242/397.3 |
| 6,511,089 | B1 * | 1/2003 | Kores, Sr. | B60D 1/38 | 280/478.1 |
| 6,523,806 | B2 * | 2/2003 | Bartal | B66D 1/00 | 254/272 |
| 2014/0374567 | A1 * | 12/2014 | Weidner | F16M 13/022 | 248/652 |

* cited by examiner

*Primary Examiner* — Sang K Kim
*Assistant Examiner* — Nathaniel L Adams

(57) ABSTRACT

A system and method for a load-facing winch are described for hauling or lifting loads at least 30° from center of the primary support object. The load-facing winch includes a winch-mount that includes a housing, a center-pivot, a mounting-plate, and a plurality of springs. The mounting-plate is attached to the winch and tilts and/or turns about the center-pivot, which allows the winch to face the load. By directing the winch to face the load, angular resistance against a moving fairlead may be reduced.

17 Claims, 15 Drawing Sheets

214

LOAD-FACING WINCH

TECHNICAL FIELD

The present disclosure relates generally to the field of motorized winches. More specifically, the present disclosure relates to a winch support structure.

BACKGROUND

Winches are hauling or lifting devices, which pull in or let out a line. Winches function by winding or unwinding the line that is coiled around a horizontal rotating drum. When a winch is motorized, a winch-line-guide is commonly used to direct the line along the drum as it winds or unwinds. Typically, the winch is mounted to a primary support object to provide stability for the winch as it hauls or lifts a load. When the primary support object is not directly facing the load, the tension from the load can disrupt and in some cases overpower the movement of the fairlead as it attempts to guide the line during winding. Thus, one problem that is frequently encountered is how to guide the line along the drum when the primary support object does not or is unable to directly face the load. Embodiments and methods disclosed herein may improve performance of winches when hauling or lifting indirect loads.

SUMMARY OF THE INVENTION

Disclosed herein is a winch, comprising a winch-mount, which may overcome the limitation of existing winches. In one embodiment, a winch comprises a winch-mount, wherein the winch-mount allows the winch to turn and/or tilt about a pivot to face the direction of a load. When the winch is not in use, the winch may be directed by the winch-mount to return to a natural resting position in relation to a primary support object to which the winch is connected.

Also disclosed herein is a method to reduce angular resistance on a winch that is created by an indirect load. The method includes directing the position of the winch such that a fairlead of a winch-line-guide faces the load.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Figure 1A:
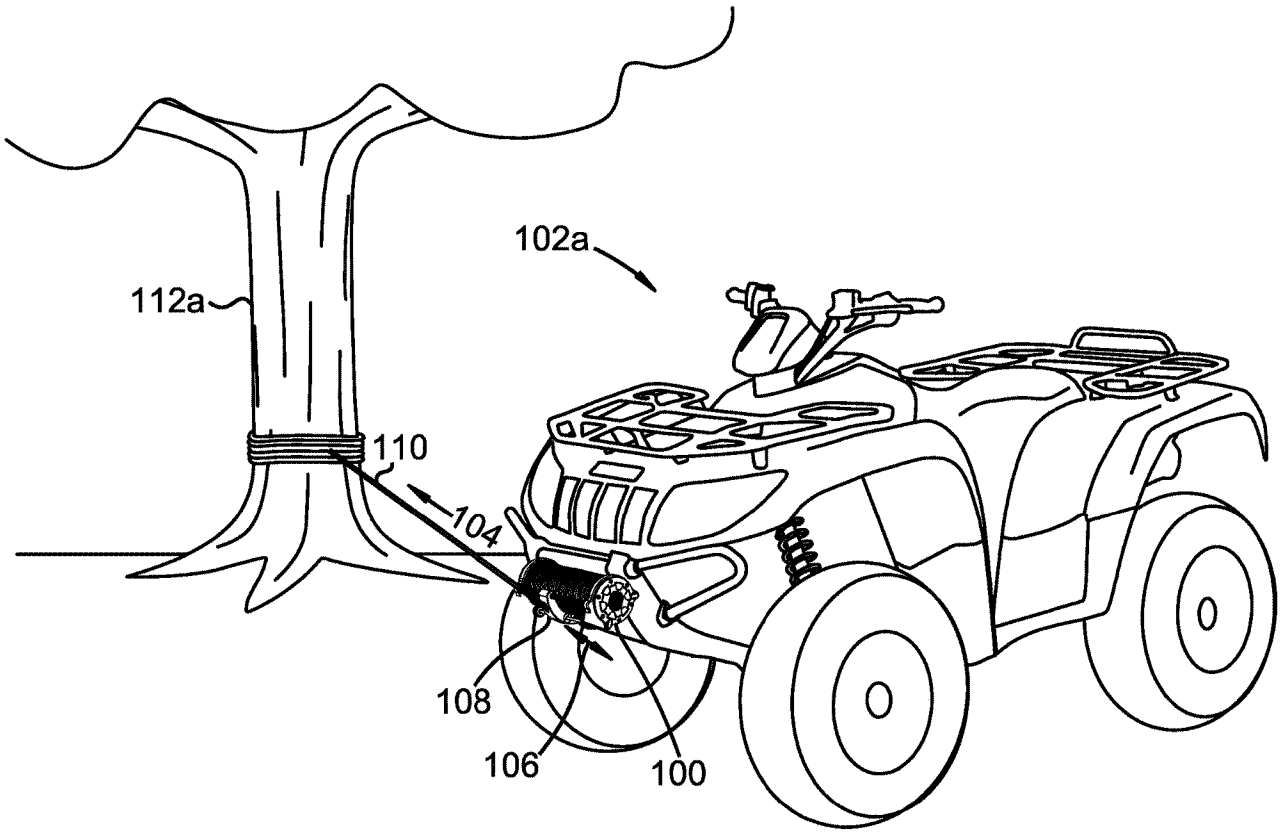
FIGS. 1A-C depict various embodiments of a winch letting in a line connected to a load at least 30° from center of the direction the winch faces.

In the following detailed description, numerous specific details are provided for a thorough understanding of the various embodiments disclosed herein. The embodiments disclosed herein can be manufactured without one or more of the specific details, or with other methods, components, materials, etc. In addition, in some cases, well-known structures, or characteristics may be combined in any suitable manner in one or more alternative embodiments.

Motorized winches may include a winch-line-guide that directs the line to wind along the length of the rotatable drum to avoid bunching or catching of the line on the rotatable drum. In one embodiment, a motor powers the drum to rotate about an axis within a frame. A fairlead of the winch-line-guide is connected to and simultaneously moves along the length of one or more elongated rods, which extend longitudinally within the frame in substantially parallel relation to the drum axis.

As the fairlead moves along the rods, the line passes through the fairlead such that the fairlead directs the line to wind uniformly around the drum. The fairlead may, at times, be unable to move along the drum length due to the force of the load working against the movement direction of the fairlead. A winch-mount that changes the direction of the drum and fairlead face may resolve this problem and allow the fairlead to smoothly move along the length of the drum.

In one embodiment winch-mount may include a housing with a center-pivot located in the middle of the housing. The housing may include one or more latches, clamps, and/or other securement mechanisms for securing the housing to the primary support object.

The center-pivot may protrude from the interior of the housing, according to one embodiment, and extend through a center-hole in the middle of a mounting-plate. In one embodiment the tip of the center-pivot may be wider than both the shaft of the center-pivot protrusion and the center-hole of the mounting-plate through which the shaft extends. Embodiments of the tip of the center-pivot may form a sphere, plate, rhombus, polyhedron, bowl-shape and/or other suitable shape.

In one embodiment, the mounting-plate may oscillate, rotate, balance, pivot, turn, tilt, teeter, vacillate, hover, hang, sway, and/or dither. The mounting-plate may be connected to the rotatable drum in one embodiment. The winch may include one or more spacers, insertions, and/or attachments between the rotatable drum and the mounting-plate. Some embodiments of the mounting-plate may include one or more protrusions, attachments, flanges, extensions, shelves, depressions, grooves and/or other surface discontinuities that interact with the springs. The mounting-plate may also include materials with a stronger composition than the resistance applied by the springs. In one embodiment, the mounting-plate may include one or more folds, bends, creases, and/or curvatures such that the degree to which the rotatable drum tilts is as much as 180° from rest. The mounting-plate may also rotate as much as 360° around the center pivot, according to one embodiment.

A plurality of springs may direct the degree to which the mounting-plate may tilt and/or turn within the housing. One or more springs of the winch-mount are arranged parallel, perpendicular, and/or diagonal to the mounting-plate. The springs may be attached directly to the housing and/or mounting-plate, according to one embodiment, or the springs may be attached to one or more securement brackets. In one embodiment, securement brackets may extend from the housing and/or mounting-plate. The winch-mount may include one or more compression springs, variable springs, coil springs, flat springs, serpentine springs, cantilever springs, coil springs, volute springs, wave spring, and/or any spring belonging to another spring classification that absorbs movement. One or more springs of the winch-mount may be comprised of steel alloys, carbon steel, ferrous metals, stainless steels, exotic alloys such as Elgiloy, Inconel X-750, and A286 alloy, non-ferrous metals, oil tempered spring wire, and/or any other material suitable to absorb movement. In one embodiment, the springs may have less compressional resistance than the force exerted to move the fairlead. One ore more of the springs may include one or more lubricants to facilitate spring movement, according to one embodiment.

Figure 1B:
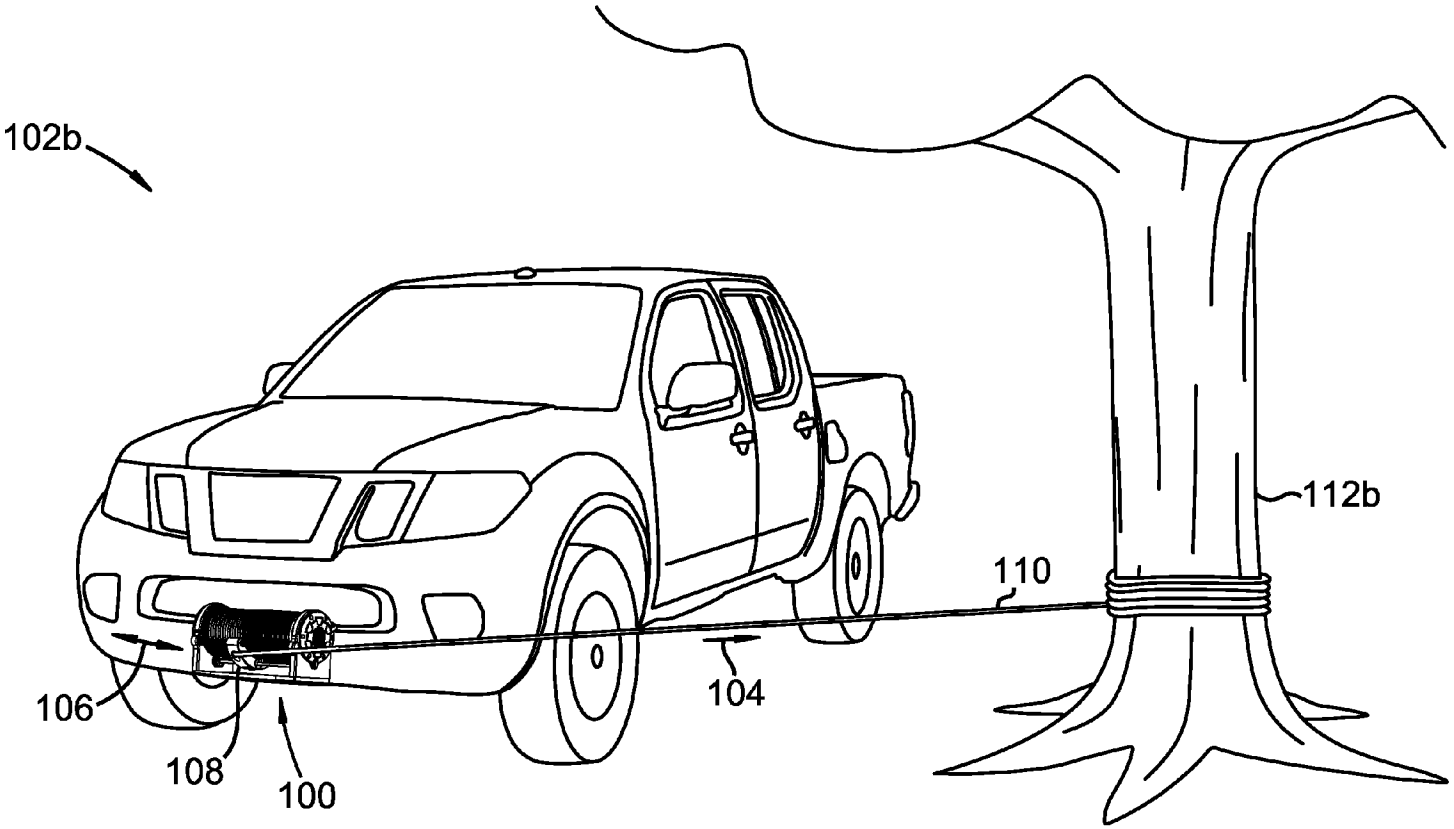
Figure 1C:
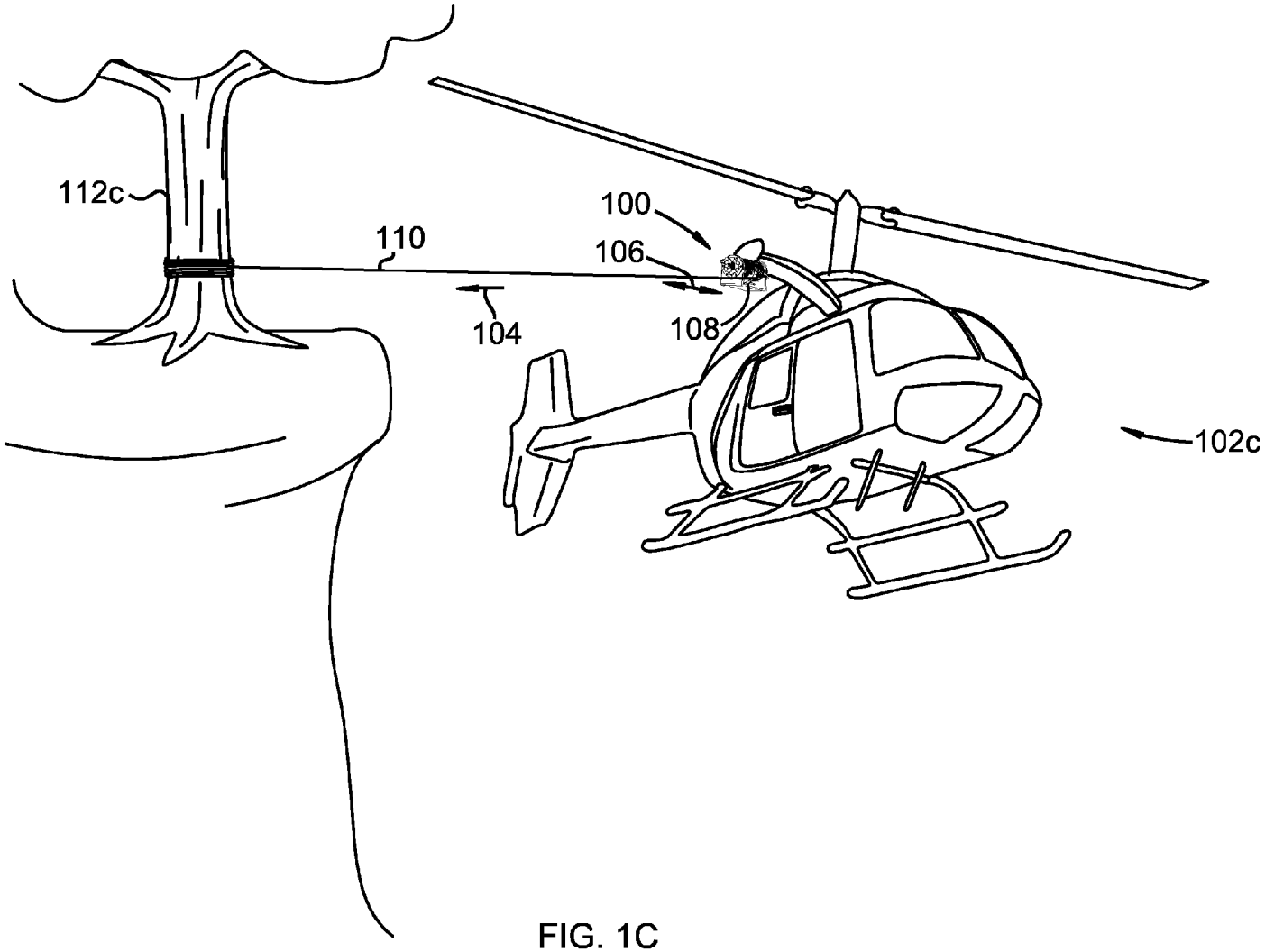

FIGS. 1A-C depict various embodiments of a winch 100 letting in a line 110 connected to a load 112*a* at least 30° from center of the direction the winch 100 faces. FIG. 1A depicts a winch 100, according to one embodiment, attached to a primary support object 102*a*, in the form of an all-terrain vehicle. The winch 100 includes a fairlead 108 that moves laterally from left to right. The force 104 from the load 112*a* may at times directionally oppose fairlead movement 106, which may disrupt and even overpower fairlead movement 106.

FIG. 1B is another view of a winch 100 attached to a primary support object 102*b*, in this case an automobile, with the line 110 connected to a load 112*b* at least 30° from center of the direction the winch 100 faces. The winch 100 includes a fairlead 108 that moves laterally within the winch 100. The load 112*b* in this illustration exerts a force 104 against the line that opposes fairlead movement 106 in an alternative direction from the load 102*a* in FIG. 1A.

FIG. 1C illustrates an embodiment of a winch 100 attached to a primary support object 102*c*, such as an aircraft, with the line 110 connected to a load 112*c* at least 30° from center of the direction the winch 100 faces. The force 104 from the load 112*c* does not necessarily have to directly oppose fairlead movement 106 in order to disrupt the ability of the fairlead 108 to function properly. At times the force 104 directed at least 30° from center of the winch 100 may cause the line 110 to rub, catch, tangle, and/or otherwise impede the functionality of the winch 100. Such disruptions may be resolved if the winch 100 was able to tilt and/or turn.

Figure 2:
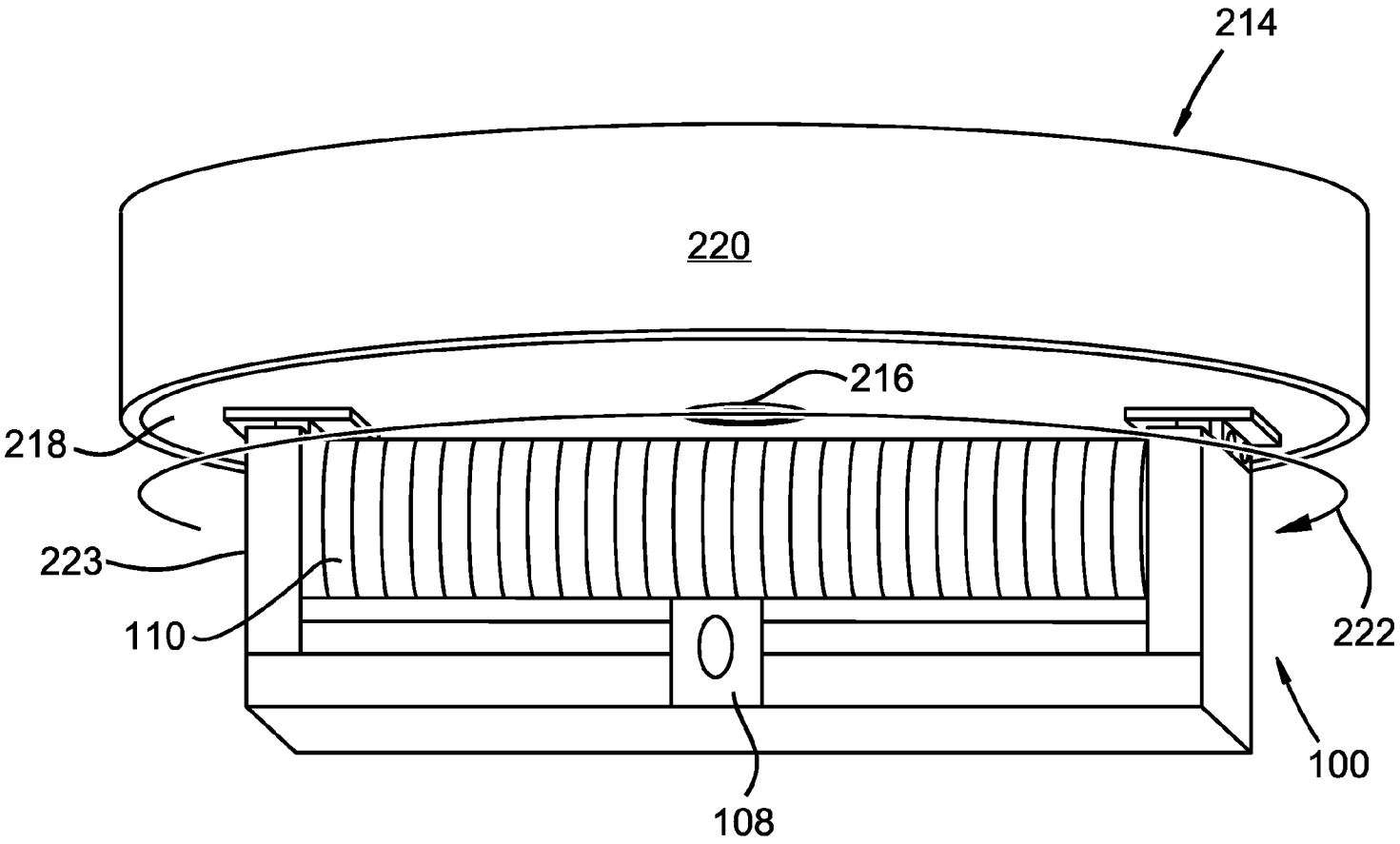
FIG. 2 illustrates a winch, according to one embodiment, comprising a winch-mount.

FIG. 2 illustrates a winch 100, according to one embodiment, comprising a winch-mount 214. One embodiment of the winch-mount 214 may include a cylindrical housing 220 and a disc-shaped mounting-plate 218. A frame 223 for the rotatable drum may be connected to the mounting-plate 218, which may rotate 222 about a center-pivot 216.

Figure 3:
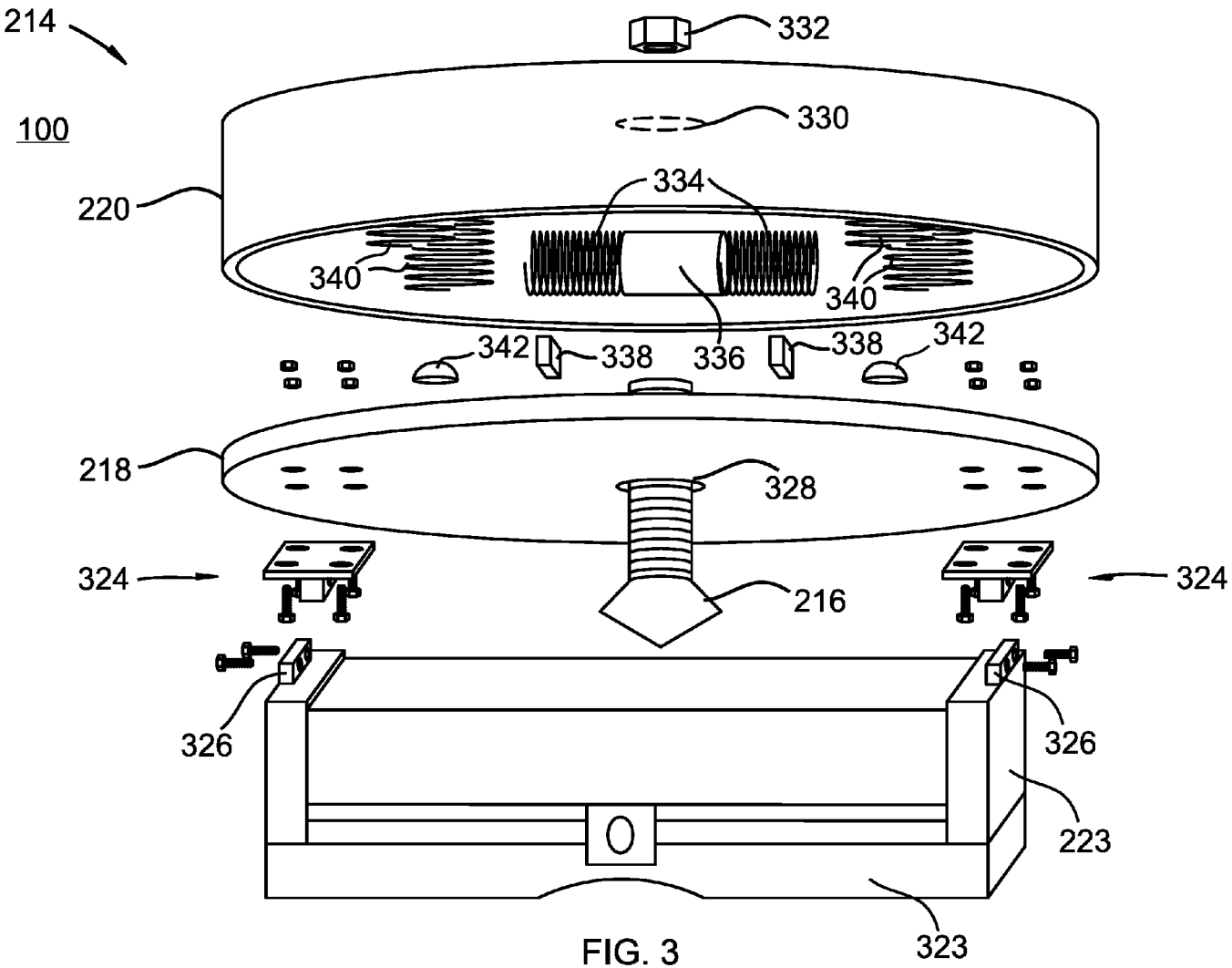
FIG. 3 portrays an exploded view of a winch-mount of a winch, according to one embodiment.

FIG. 3 portrays an exploded view of a winch-mount 214 of a winch 100, according to one embodiment. The winch-mount 214 may include a frame 223 comprising one or more inserts 326 that fit within a corresponding number of attachments 324, and that connect the frame 223 for the rotatable drum to the mounting-plate 218. The center-pivot 216 may protrude through a hole 328 in the center of the mounting-plate 218 and continue up through the housing 220 and into a housing-hole 330. The center-pivot 216 may be secured with a bolt 332 or other attachment at the upper surface of the housing 220. In another embodiment, the center-pivot 216 may be directly attached to the housing.

The housing 220 may include one or more horizontal-springs 334 transverse to the center-pivot 216 that are attached to a spring-securement bracket 336 that extends from the housing 220. The mounting-plate 218 may include one or more protrusions 338 that interact with the horizontal-springs 334. In addition to the horizontal-springs 334, the housing 220 may also include vertical-springs 340 that extend downward from the housing 220. One or more knobs 342 may be positioned on the mounting-plate 218 so as to interact with the vertical-springs 340.

Figure 4A:
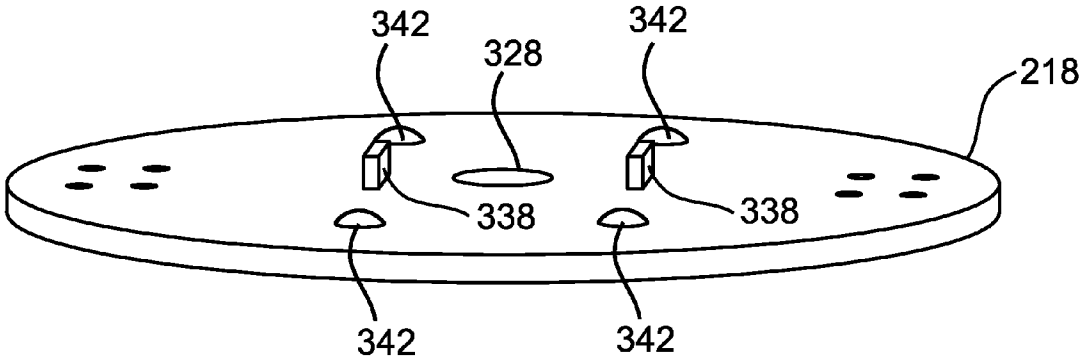
FIG. 4A illustrates an overhead view of an embodiment of a mounting-plate for a winch-mount.

FIG. 4A illustrates an overhead view of an embodiment of a mounting-plate 218 for a winch-mount 214. The mounting-plate 218 may include one or more protrusions 338 that may interact with one or more horizontal-springs (see FIG. 3). Additionally, the mounting-plate 218 may include knobs 342 that interact with vertical-springs (see FIG. 3). The mounting-plate 218 may also include a hole 328 through which the center-pivot (see FIG. 3) may pass.

Figure 4B:
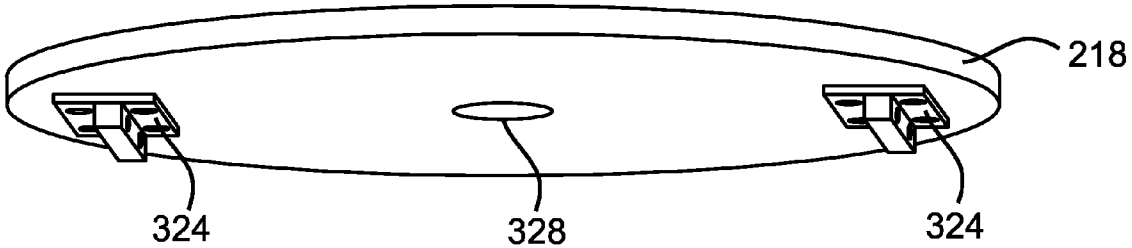
FIG. 4B depicts an underside view of the mounting-plate of FIG. 4A.

FIG. 4B depicts an underside view of the mounting-plate 218 of FIG. 4A. The underside may include one or more attachments 324 for securing the frame (see FIG. 3) for the rotatable drum. The mounting-plate 218 may also include a hole 328 through which the center-pivot (see FIG. 3) may pass.

Figure 5A:
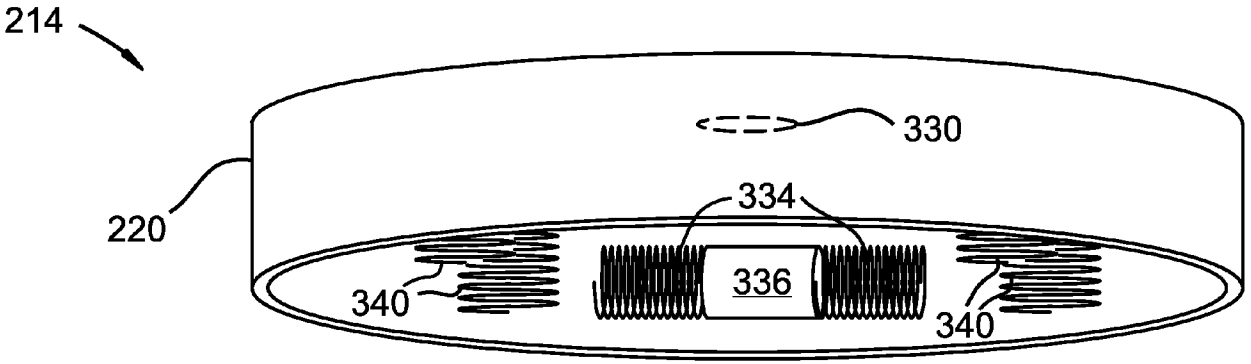
FIG. 5A is a perspective view of an underside of a housing for a winch-mount, according to one embodiment.

FIG. 5A is a perspective view of an underside of a housing 220 for a winch-mount 214, according to one embodiment. The underside of the housing 220 may include one or more horizontal-springs 334 and/or vertical-springs 340. The horizontal-springs 334 and/or vertical-springs 340 may attach directly to the housing 220 and/or attach to one or more spring-securement brackets 336. Some embodiments of the housing 220 may include a housing-hole 330.

Figure 5B:
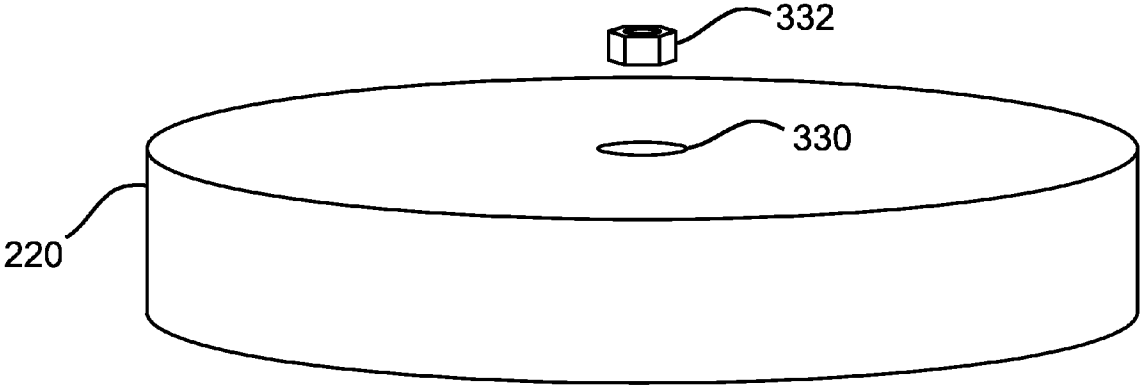
FIG. 5B is a perspective view of the top of the housing of FIG. 5A.

FIG. 5B is a perspective view of the top of the housing 220 of FIG. 5A. The housing 220 may include a housing-hole 330 through which a center-pivot (see FIG. 3) may penetrate and attach to a bolt 332.

Figure 5C:
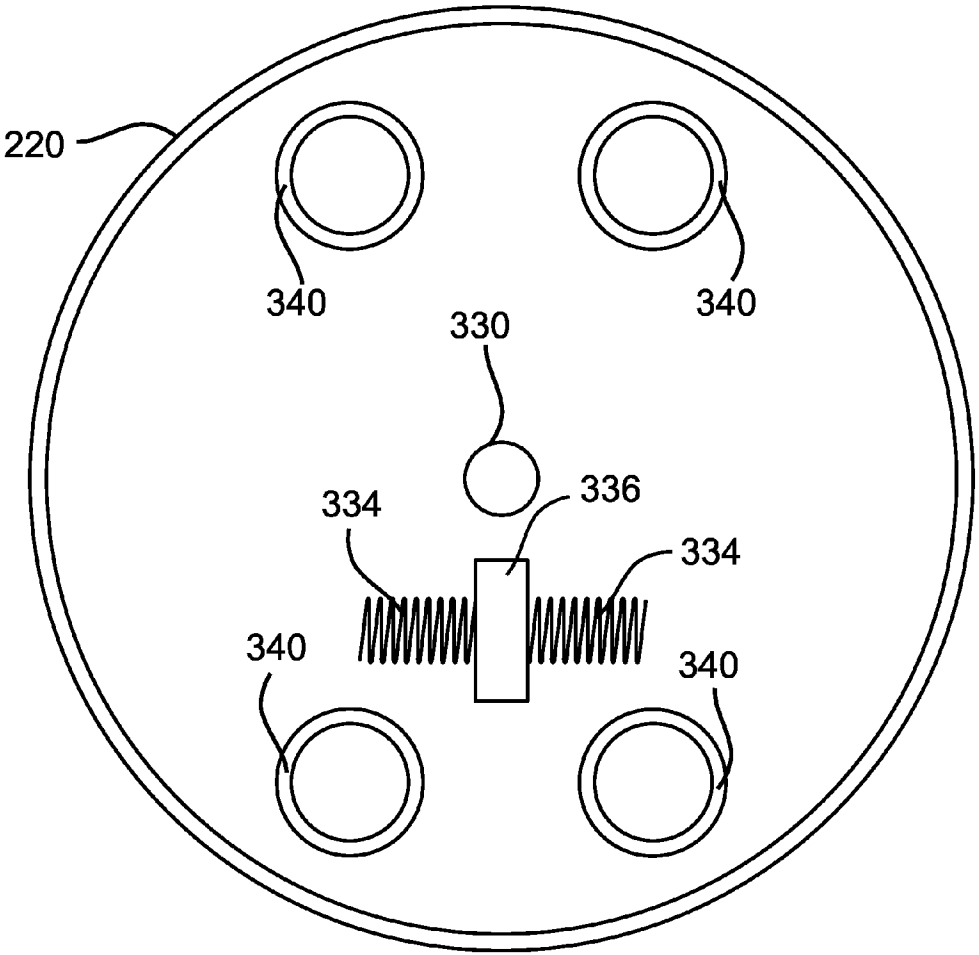
FIG. 5C is an underneath view of the housing of FIGS. 5A-B.

FIG. 5C is an underneath view of the housing 220 of FIGS. 5A-B. This embodiment shows a housing 220 includes four vertical-springs 340 and two horizontal-springs 334. The horizontal-springs 334 are positioned such that protrusions from the mounting-plate (see FIG. 3) may rotate freely until coming into contact with the horizontal-springs 334. The vertical-springs 340 may receive compressional forces from the mounting-plate itself and/or knobs on the mounting-plate. The housing 220 may also include a housing-hole 30.

Figure 6A:
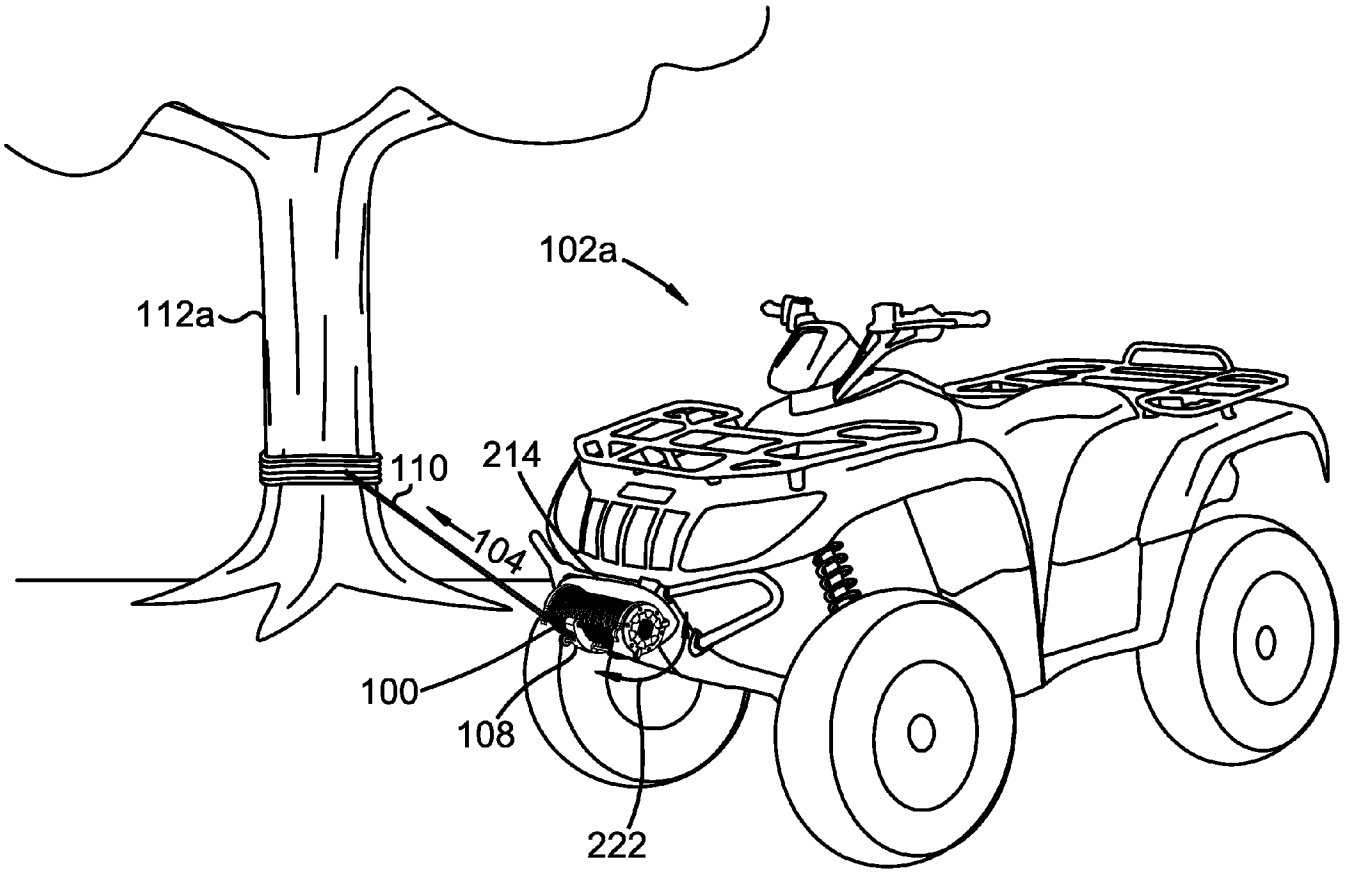
FIGS. 6A-C depict various embodiments of a winch that includes a winch-mount, letting in a line connected to a load at least 30° from center of a primary support object.
Figure 6B:
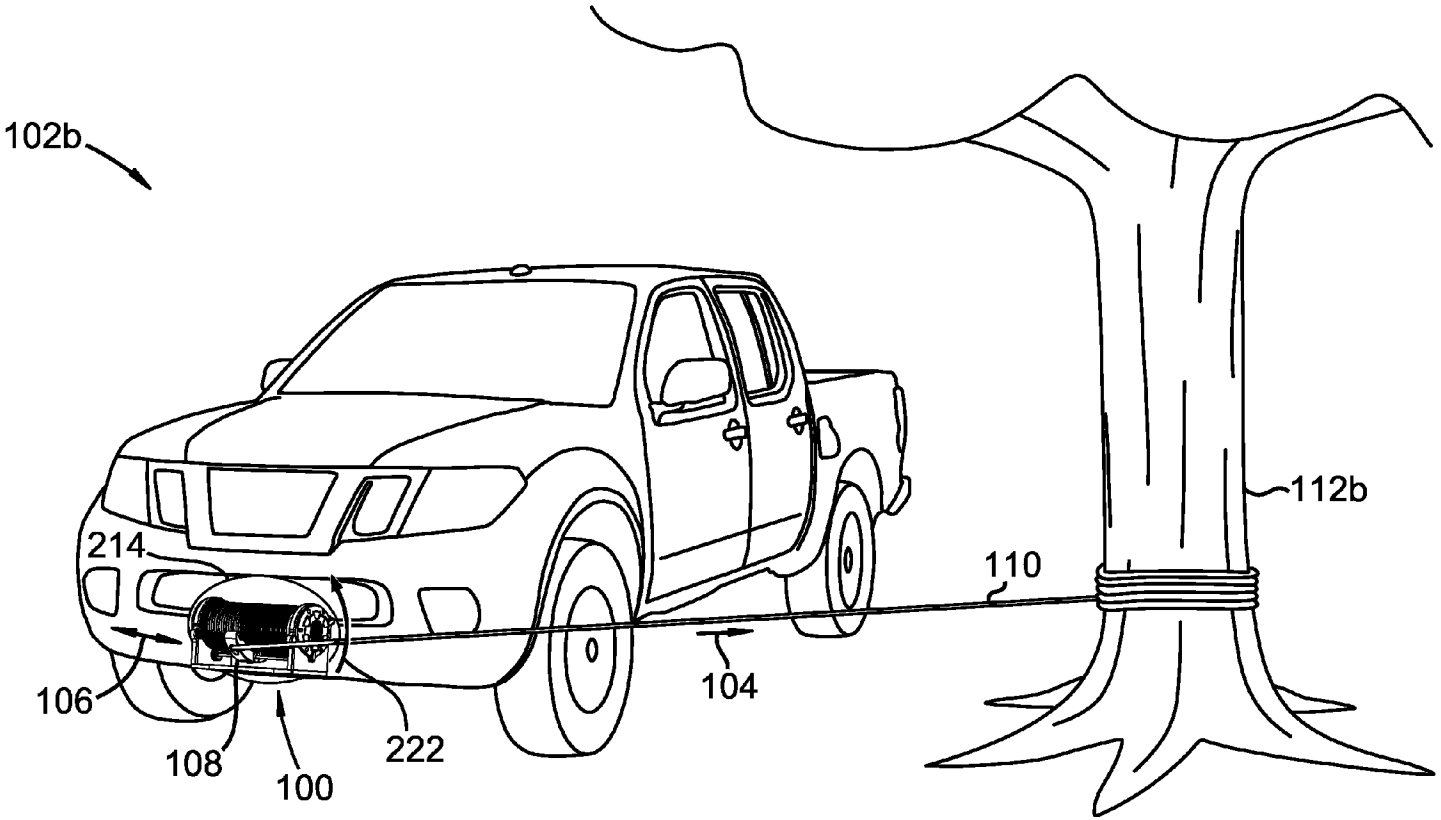
Figure 6C:
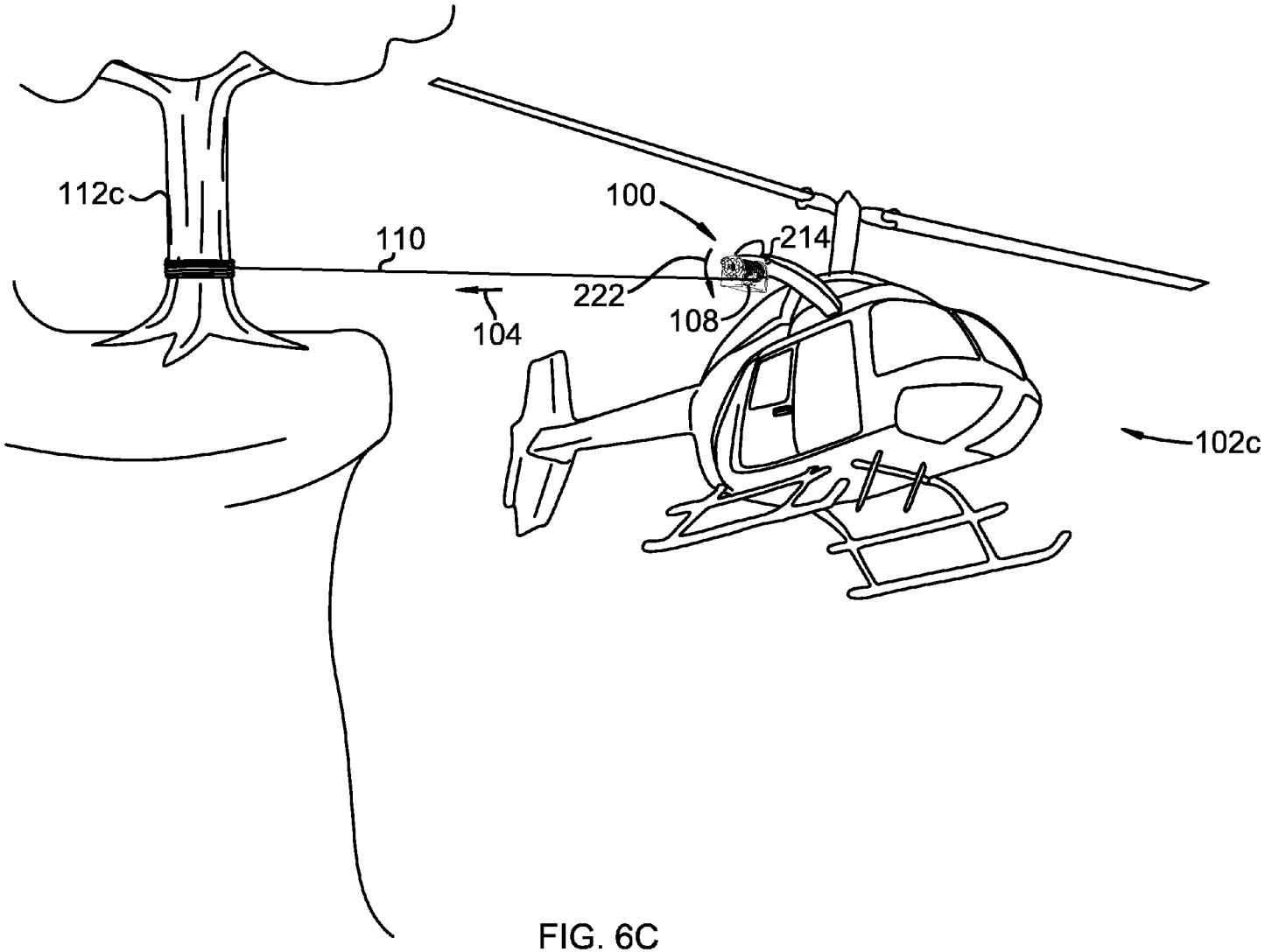

FIGS. 6A-C depict various embodiments of a winch 100 that includes a winch-mount 214, letting in a line 110 connected to a load 112*a-c* at least 30° from center of a primary support object 102*a-c*. In FIG. 6A, the winch 100 may rotate 222 clockwise to face the load 112*a*. In FIG. 6B, the winch 100 may rotate 222 counter-clockwise to face the load 112*b*. In FIG. 6C, the winch 100 may rotate 222 and/or tilt 643 in the direction of the load 112*c*.

Figure 6D:
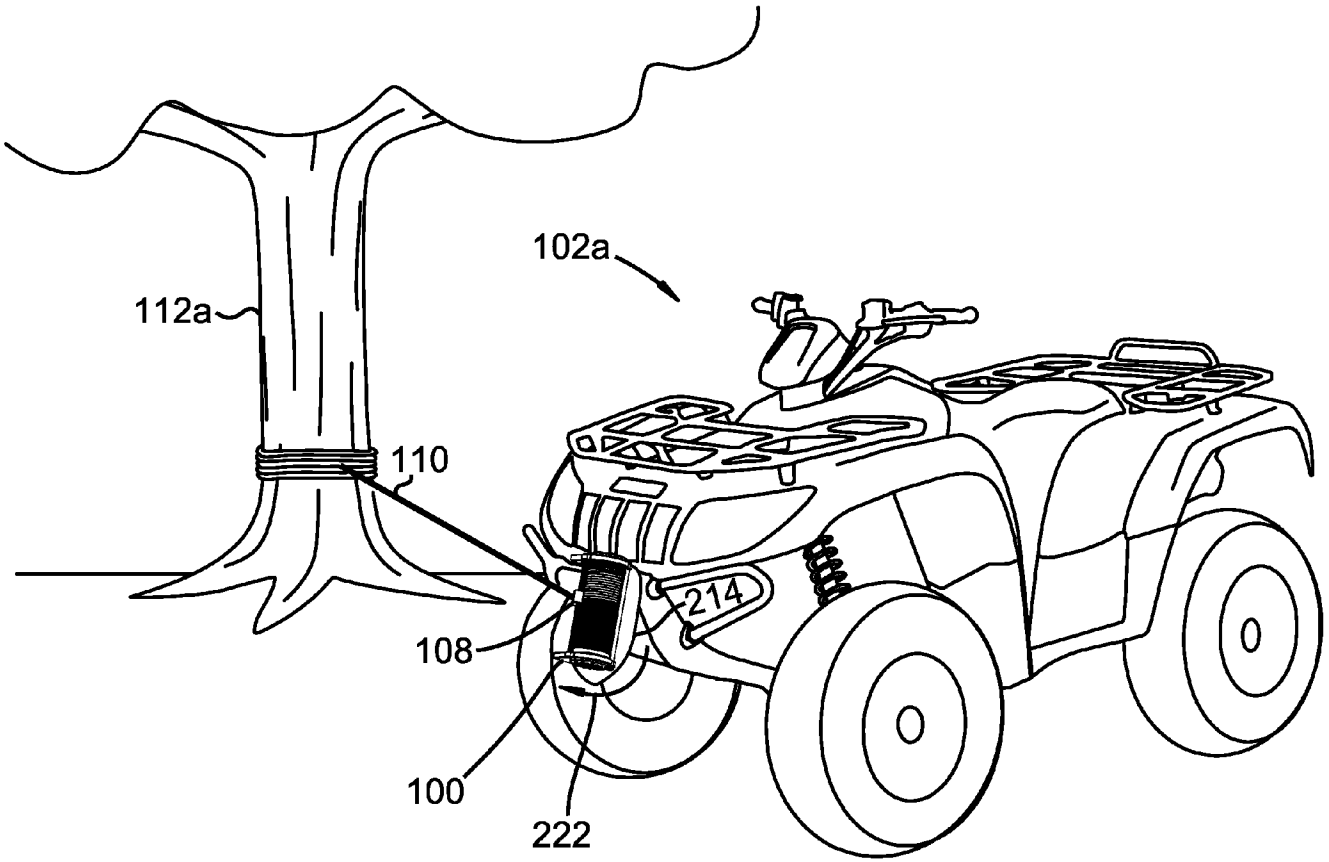
FIGS. 6D-F are illustrations of the winch from FIGS. 6A-C that depict the winch post-rotation and/or post-tilt such that the winch now faces the load.
Figure 6E:
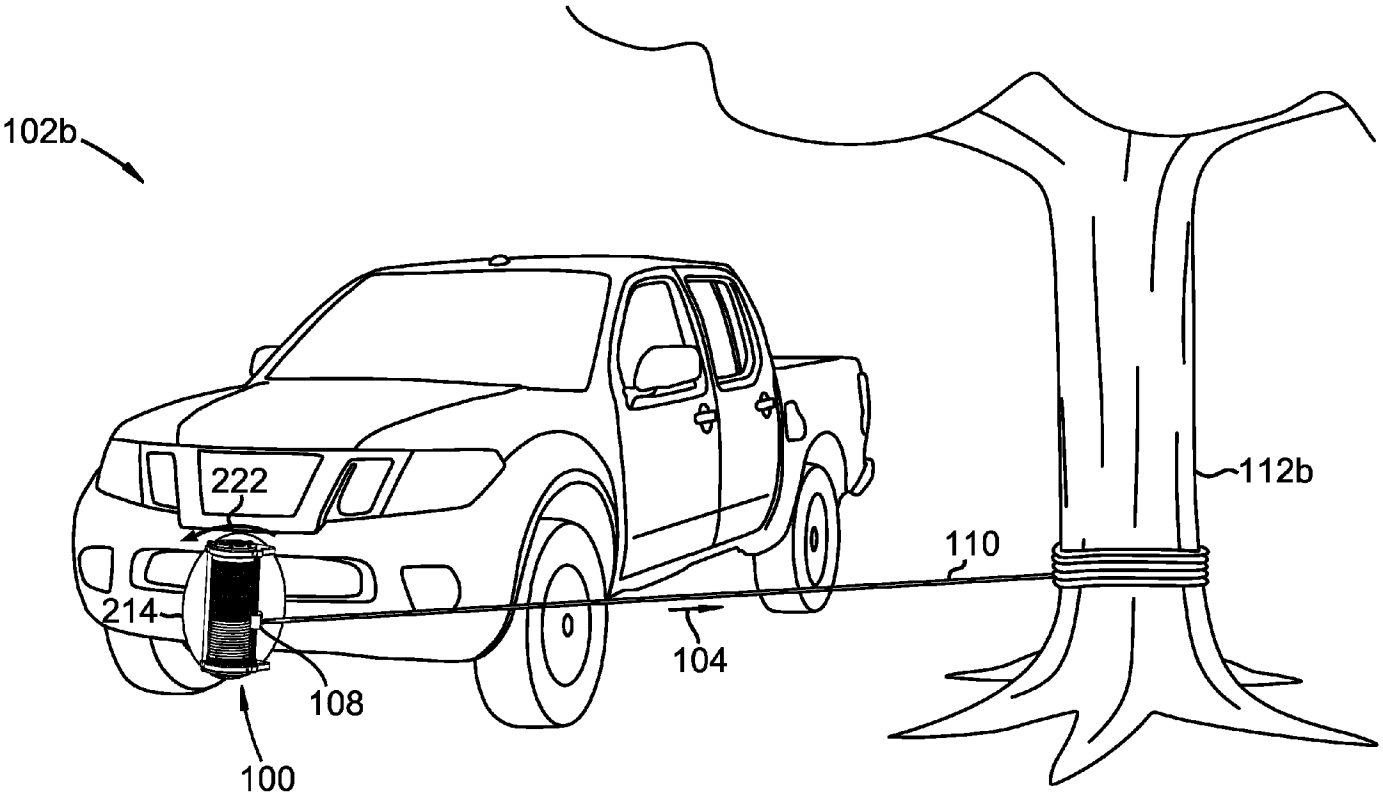
Figure 6F:
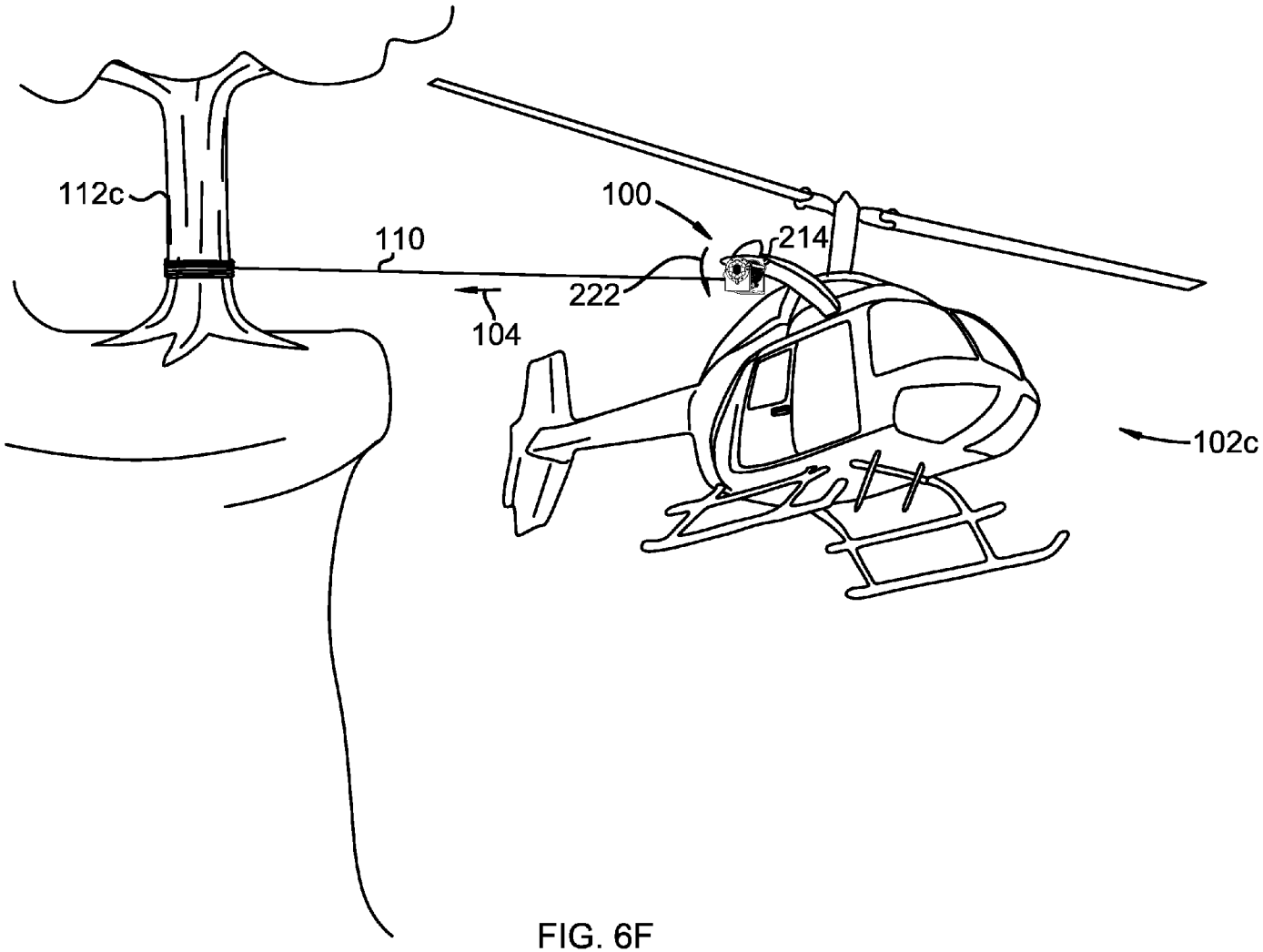

FIGS. 6D-F are illustrations of the winch 100 from FIGS. 6A-C that depict the winch 100 post-rotation and/or post-tilt such that the winch 100 now faces the load 112*a-c*. In FIG. 6D, the winch 100 and the fairlead 108 now face the load 112*a*, and there are no longer forces that work against fairlead movement 106. Similarly, the winch 100 of FIG. 6E faces the load 112*b* such that there are no longer forces that work against fairlead movement 106. In FIG. 6F, the winch 100 has either rotated and/or tilted to face the load 112*c*, thus reducing the likelihood that the line 110 will rub, catch, tangle, and/or otherwise impede the functionality of the winch 100.

Figure 7:
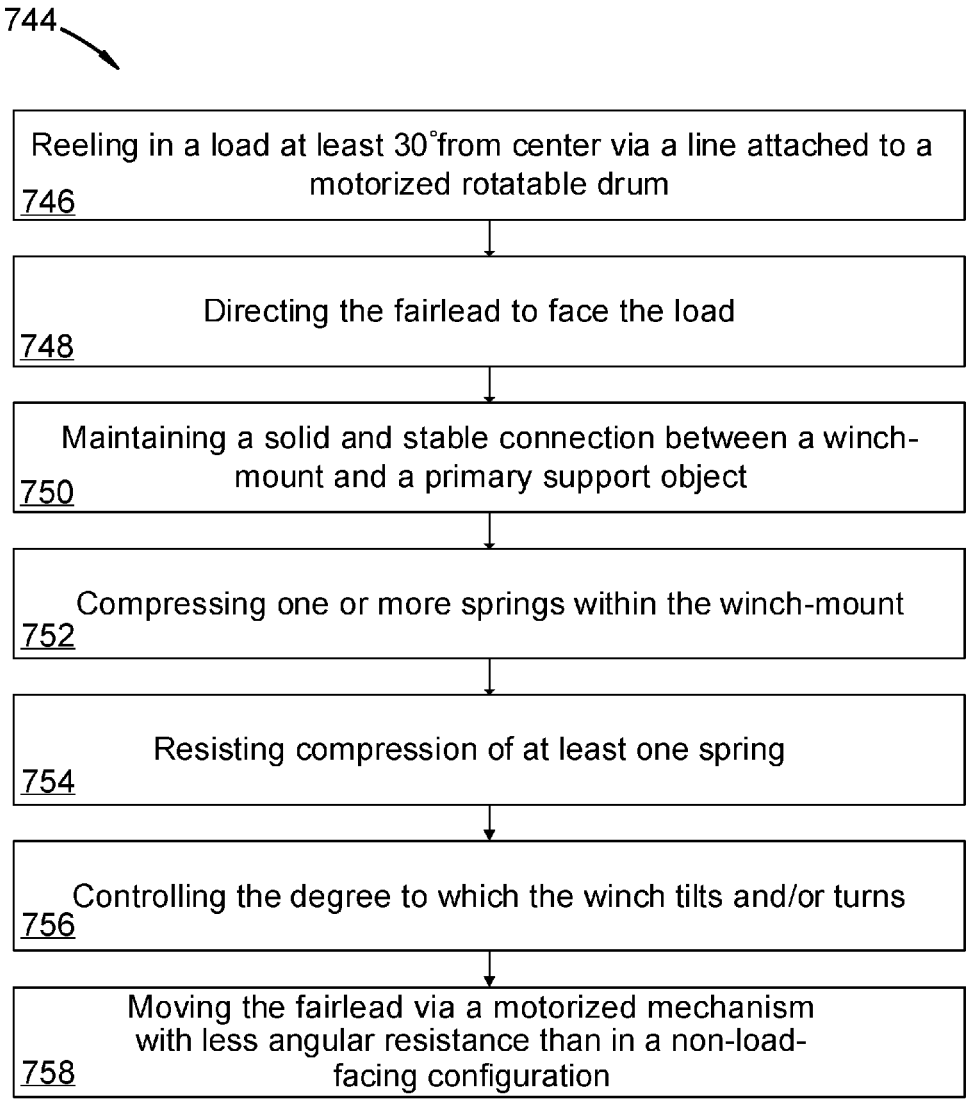
FIG. 7 is a flow chart of a method for reducing angular resistance against a moving fairlead, according to one embodiment.

FIG. 7 is a flow chart of a method 744 for reducing angular resistance against a moving fairlead, according to one embodiment. The method 744 may include reeling 746 in a load at least 30° from center via a line attached to a motorized rotatable drum. The method 744 may further comprise directing 748 the fairlead to face the load, and maintaining 750 a solid and stable connection between a winch-mount and a primary support object. Additionally, the method 744 may include compressing 752 one or more springs within the winch-mount. The method 744 may also include resisting 754 compression of at least one spring, and controlling 756 the degree to which the winch tilts and/or turns. The method 744 may further include moving 758 the fairlead via a motorized mechanism with less angular resistance than in a non-load-facing configuration. In one embodiment, the method 744 may further comprise providing tension to one or more of the springs within the winch-mount.

The invention claimed is:

1. A winch comprising:

a motor;

a rotatable drum for winding a line;

wherein the rotatable drum is connected to the motor;

a winch-line-guide for positioning the line during winding, comprising:

an elongated rod extending longitudinally within a frame for the rotatable drum and in substantially parallel relation to the axis of rotation of the drum, a fairlead through which the line penetrates, wherein the fairlead is connected to the rod, and wherein the fairlead is movable along the length of the rod;

a winch-mount comprising:

a housing;

wherein the housing is attached to a primary support object;

a center-pivot;

wherein the center-pivot is attached to the housing;

wherein the axis of rotation of the center-pivot is perpendicular to the axis of rotation of the drum, and the axis of rotation of the center-pivot passes through the drum;

a mounting-plate to which the rotatable drum is attached;

wherein the mounting-plate is rotatably connected to the center-pivot;

a plurality of springs each attached at one end to the housing and at the other end to the mounting-plate for biasing rotation of the mounting plate about the center-pivot; and wherein, when the fairlead is unable to move along the length of the guide rod due to a force of a load working against a movement direction of the fairlead, the winch and mounting plate rotate about the center-pivot such that the force of the load is relieved, and the fairlead is able to move along the length of the guide rod.

2. The winch of claim 1, wherein the winch-mount further comprises one or more spring-securement brackets that extend from the housing or mounting-plate, and to which one or more springs are attached.

3. The winch of claim 1, wherein the springs attached to the housing and mounting plate are directly secured to the housing and mounting-plate.

4. The winch of claim 1, wherein the winch-mount comprises one or more compression springs, variable springs, coil springs, flat springs, serpentine springs, cantilever springs, coil springs, volute springs, or wave spring.

5. The winch of claim 1, wherein one or more springs of the winch-mount are comprised of steel alloys, carbon steel, ferrous metals, stainless steels, non-ferrous metals, or oil tempered spring wire.

6. The winch of claim 1, wherein the housing of the winch-mount is cylindrical and the mounting-plate is disc-shape, allowing the mounting-plate to rotate within the housing.

7. The winch of claim 1, wherein the mounting-plate of the winch-mount comprises a center-hole through which the center-pivot penetrates.

8. The winch of claim 7, wherein a tip of the center-pivot of the winch-mount comprises a sphere, a plate, a rhombus, or a polyhedron, upon which the mounting-plate oscillates, turns, rotates, balances, pivots, tilts, teeters, vacillates, hovers, hangs, or sways.

9. The winch of claim 1, wherein the winch-mount further comprises one or more protrusions, attachments, flanges, extensions, shelves, depressions, grooves or other surface discontinuities on the mounting-plate that interact with the springs.

10. The winch of claim 1, wherein the winch-mount further comprises one or more spacers, insertions, or attachments between the frame for the rotatable drum and the mounting-plate.

11. The winch of claim 1, wherein the plurality of springs of the winch-mount comprise less compressional resistance than a force necessary to move the fairlead in a direction opposite a load.

12. The winch of claim 1, wherein the plurality of springs of the winch-mount comprise one or more lubricants.

13. The winch of claim 1, wherein the plurality of springs of the winch-mount are arranged parallel, perpendicular, or diagonal to the mounting-plate.

14. The winch of claim 1, wherein the mounting-plate of the winch-mount comprises one or more folds, bends, creases, or curvatures such that the mounting plate rotates as much as 180° from rest.

15. The winch of claim 1, wherein the mounting-plate of the winch-mount is comprised of materials with a stronger composition than resistance applied by the plurality of springs.

16. The winch of claim 1, wherein the mounting-plate of the winch-mount rotates about the center pivot as much as 360° from rest.

17. The winch of claim 1, wherein the housing of the winch-mount comprises one or more of latches, clamps, and other securement mechanisms for securing the housing to the primary support object.

* * * * *